US010926911B2

(12) United States Patent
Bhat et al.

(10) Patent No.: US 10,926,911 B2
(45) Date of Patent: Feb. 23, 2021

(54) PLASTIC BOTTLE WITH BASE

(71) Applicant: PepsiCo, Inc., Purchase, NY (US)

(72) Inventors: Advait Bhat, White Plains, NY (US); Girolama Bueti, Yorktown Heights, NY (US); Syed Peer, Arlington Heights, IL (US); Bruno Telesca, Sandy Hook, CT (US)

(73) Assignee: PepsiCo. Inc., Purchase, NY (US)

( * ) Notice: Subject to any disclaimer, the term of this patent is extended or adjusted under 35 U.S.C. 154(b) by 40 days.

(21) Appl. No.: 16/160,616

(22) Filed: Oct. 15, 2018

(65) Prior Publication Data

US 2020/0115094 A1 Apr. 16, 2020

(51) Int. Cl.
*B65D 1/02* (2006.01)

(52) U.S. Cl.
CPC ..... *B65D 1/0284* (2013.01); *B65D 1/0207* (2013.01)

(58) Field of Classification Search
CPC ..... B65D 1/0284; B65D 1/0207; B65D 1/02
USPC ..... 215/371, 374, 375, 376; 220/606, 608
See application file for complete search history.

(56) References Cited

U.S. PATENT DOCUMENTS 3,871,541 A 3/1975 Adomaitis
5,024,339 A 6/1991 Riemer
5,713,480 A * 2/1998 Petre ..... B65D 1/0284 215/373
5,906,285 A * 5/1999 Slat ..... B29C 49/221 215/12.1
6,666,001 B2 12/2003 Mero
7,461,756 B2 12/2008 Pedmo
8,469,214 B2 5/2013 Boukobza
8,485,375 B2 7/2013 Colloud
D705,658 S 5/2014 Knapp
9,422,076 B2 8/2016 Lane
2013/0228546 A1 9/2013 Darr et al.
2014/0227399 A1 8/2014 Wortmann et al.
2015/0136727 A1* 5/2015 Hermel ..... B65D 1/0284 215/373
2016/0144992 A1 5/2016 Hermel
2016/0167825 A1 6/2016 Dachs et al.
2018/0127137 A1 5/2018 Mahajan et al.
2018/0162579 A1 6/2018 Kado et al.
2019/0308764 A1 10/2019 Pierre

OTHER PUBLICATIONS

International Search Report and Written Opinion of the International Searching Authority directed to related International Patent Application No. PCT/US19/54523, dated Feb. 4, 2020; 7 pages.

* cited by examiner

*Primary Examiner* — James N Smalley
*Assistant Examiner* — Elizabeth J Volz
(74) *Attorney, Agent, or Firm* — Sterne, Kessler, Goldstein & Fox P.L.L.C.

(57) ABSTRACT

A beverage container for a carbonated beverage may include a body and a base. The base may have a skirt that extends from the body and a dome. Ribs extend between the skirt and the dome. The base may also include a plurality of feet. Each foot may be formed between each pair of adjacent ribs. The feet may extend from the skirt to the dome. Each foot may have a seat and two sidewalls. A transition point of each rib may be between the skirt and the dome. A tangent line formed at each transition point may have a slope of zero. A transition between each foot's seat and each foot's sidewalls may be smooth.

22 Claims, 6 Drawing Sheets

PLASTIC BOTTLE WITH BASE

FIELD

The described embodiments generally relate to bases for bottles. More specifically, described embodiments generally relate to bases for carbonated soft drink beverage bottles.

SUMMARY

In some embodiments, a beverage container includes a body and a base. The base may include a skirt that extends from the body to a dome. Ribs connect the dome and the skirt. A foot may be formed between a pair of adjacent ribs and also extend from the skirt to the dome. Each foot may have a seat and two sidewalls. Each rib may have a transition point between the skirt and the dome where a tangent line formed that the transition point has a slope of zero. In some embodiments, the seat-to-sidewall transition of each foot is smooth.

The dome may include a dome angle. The dome angle may be greater than 30 degrees. Each rib may have a rib height measured from a horizontal plane defined by the seats of the feet. The dome may also have a dome height measured from the horizontal plane defined by the seats of the feet. In some embodiments, the dome height is greater than 4 times the rib height. In some embodiments, the rib height may be between 2 mm and 4 mm. For example, the rib height may be 3.7 mm. In some embodiments, the rib height may be a determined as a fraction of the horizontal outer skirt radius. For example, the rib height may be ½, ⅓, or ⅙ the horizontal outer skirt radius.

The base may also have a horizontal outer skirt radius. In some embodiments, the dome height is greater than 1.3 times the horizontal outer skirt radius. Each foot may also have seat radial width. The seat radial width may be less than 11 degrees. In some embodiments, the seat radial width may be less than 6 degrees. The number of feet may be 8 in some embodiments. The smooth seat-to-side-wall transition of each foot may have a filet radius greater than 1 mm. Additionally, in some embodiments, a slope of a tangent line formed in a plane connecting two adjacent seats at any point between two adjacent seat may have a slope less than 1.3.

In some embodiments, a base for a beverage container has a dome with a vertical axis. The base may also have ribs that extend from the dome to a skirt of the base. The base may also include feet. Each foot may be formed between a pair of adjacent ribs and may extend from the skirt to the dome. Each foot may have a seat and two sidewalls. The sidewall-to-rib transition and the seat-to-sidewall transitions may be smooth. Neither the feet nor the ribs may extend beyond a dome boundary that is defined by a smooth region.

Each sidewall may have a sidewall angle defined by a horizontal line and a tangent line formed at a sidewall inflection point. The sidewall angle may be between 30 degrees and 60 degrees. In some embodiments, the side wall angle may be between 40 and 52 degrees. Each rib may also have a rib angle. The rib angle may be defined as the angle between a transition point of the rib and the dome boundary. The rib angle may be between 40 and 50 degrees.

In some embodiments of a base for a beverage container, the base may include a skirt and feet extending from the skirt. Each foot may have a seat and two sidewalls extending from the seat. Ribs may connect adjacent sidewalls. Each rib may have an inflection point. A dome extending from the feet and the ribs may have a smooth region.

In some embodiments, the feet and ribs to not extend into the smooth region of the dome. The smooth region may define a dome radius. The dome may also have a dome height. In some embodiments, the dome height is between 1.3 and 1.7 time the dome radius. Each rib may have a rib height measured from a horizontal plane defined by the seats of the feet. In some embodiments, the rib height may be between 2 mm and 4 mm. Each foot may also have a seat radial width. In some embodiments, the seat radial width may be less than 6 degrees. In some embodiments, each foot may have a foot angle. The foot angle may be defined by a tangent line formed at an interior of the foot and a horizontal plane. In some embodiments, the foot angle may be greater than 50 degrees.

In some embodiments, a beverage container has a body and base. The base includes a skirt extending from the body. Ribs extending from the skirt connect the skirt to a dome. The dome may be centered on a vertical axis. Feet may be formed on the base. In some embodiments, each foot is formed between a pair of adjacent ribs. Each foot may extend from the skirt to the dome. Each foot may have a seat and two sidewalls. Each rib may have a transition point between the skirt and the dome where a tangent line formed at the transition point has a slope of zero. In some embodiments, when the beverage container is pressurized, the feet splay away from the vertical axis.

BRIEF DESCRIPTION OF THE DRAWINGS

The accompanying drawings, which are incorporated herein and form a part of the specification, illustrate embodiments of the present disclosure by way of example, and not by way of limitation. Together with the description they further serve to explain principles of the disclosure and enable a person skilled in the pertinent art to make and use the disclosure.

DETAILED DESCRIPTION

Figure 1:
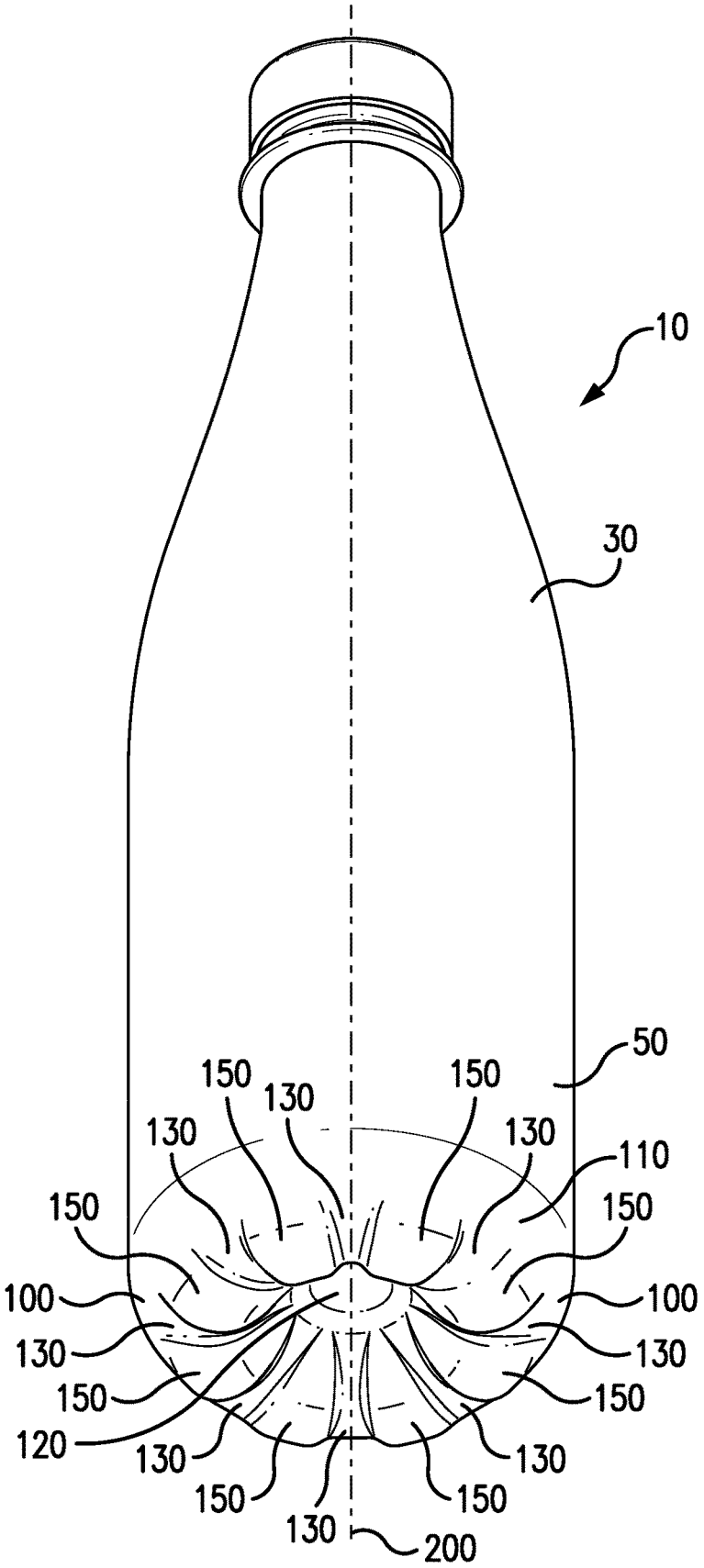
FIG. 1 is a bottom perspective view of a beverage container having a base according to some embodiments.

The present invention will now be described in detail with reference to embodiments thereof as illustrated in the accompanying drawings. References to "one embodiment," "an embodiment," "an example embodiment," "some embodiments," etc., indicate that the embodiment described may include a particular feature, structure, or characteristic, but every embodiment described may not necessarily include that particular feature, structure, or characteristic. Similarly, other embodiments may include additional features, structures, or characteristics. Moreover, such phrases are not necessarily referring to the same embodiment. When a particular feature, structure, or characteristic is described in connection with the embodiment, it is submitted that it is within the knowledge of one skilled in the art to effect such feature, structure, or characteristic in connection with other embodiments whether or not explicitly described.

The terms "invention," "present invention," "disclosure," or "present disclosure" as used herein are non-limiting terms and are not intended to refer to any single embodiment of the particular invention but encompasses all possible embodiments as described in the application.

Plastic beverage containers may contain a variety of beverages including carbonated beverages. Carbonated beverages may include, for example, soda, beer, or carbonated water. The level of carbonation may vary depending on the beverage. For example, some sodas may be carbonated to 4.2 atmospheres. Also, for example, carbonated waters may be carbonated to between 2.7 and 3.1 atmospheres.

Plastic beverage containers have a variety of bases. Each base is designed to withstand the pressures exerted by the carbonated beverage contained in the beverage container. In addition to the retention and supporting function of beverage containers, customers may associate the base of the beverage container with a type of beverage. For example, customers may associate a petaloid base with a carbonated soft drink such as soda. Or, for example, customers may associate a champagne bottle base with a premium beverage.

Champagne bases for plastic beverage containers evoke the look of the classic glass champagne bottle base. These structures are found on some glass bottles and have an elegant and timeless look. The classic champagne bottle base has a dome structure, or punt, formed into the base with the apex of the dome rising into the area containing the beverage. A bearing zone connects the dome to the side walls of the beverage container. The beverage container may rest on the bearing zone when upright on a horizontal surface.

The dome of the champagne base is generally well-suited to the internal pressure of a carbonated beverage contained in a beverage container because of the continuous sloping nature of the dome. This evenly distributes the pressure exerted by the contained carbonated beverage on the dome and the bearing region. However, the bearing regions must sufficiently support the pressure from the dome so that the dome does not protrude out, invert, or shift off of a center axis of the beverage container. When a glass bottle is used, the strength of the glass alone may support the dome. No specific or intricate geometries of the champagne base may be necessary in glass beverage containers.

In contrast with glass beverage containers, plastic containers are lighter and thinner. The relatively thin material at the bearing zone may cause an asymmetric deformation of the bearing zone when the beverage container is subjected to pressure from a carbonated beverage in the beverage container. Such deformation of the bearing zone may cause asymmetric swelling of the bearing zone increasing instability of the beverage bottle base. This instability of the beverage bottle base may make the beverage bottle more susceptible to asymmetric leaning or tipping over, since the container rests on its bearing zone when placed on a surface. Under some conditions, as the bearing zone deforms, the dome also begins to deform. For example, as one part of the bearing zone expands or bulges, areas of the dome may move towards the bulge bringing the dome off of the vertical axis. This deformation may cause the distribution of force on the surface of the dome to lose its symmetry. The resulting asymmetry of forces on the dome may lead the dome to invert.

Risk of deformation of the bearing zone may be reduced in several ways. First, more material may be added to the base of the beverage container to increase the thickness and strength of the bearing zone. However, the addition of material to the bearing zone undesirably increases the weight and material cost of the container. Using thick plastic at the bottom of the plastic beverage container may not be desirable because it adds weight and material to the bottle. The extra weight and material increase transportation and manufacturing costs. Second, the geometry and structure of the champagne base may be altered to support the loading on the dome and the bearing zone without a substantial increase in thickness.

Embodiments of the present invention provide a base supported by structural geometry of the base. These structures contribute to the structural integrity of a champagne base for a beverage container. Specifically, embodiments relate to increasing the structural stability of the dome and preventing deformations of the base of a plastic beverage container. In some embodiments, the dome may be supported by ribs. The pressure exerted by the pressured beverage on the dome may be transferred to ribs formed on the base. The ribs may extend from the dome to the side wall of the beverage container. Unlike the dome, which extends into the area containing the beverage, the ribs may extend away from the area containing the beverage. That is, they may have an opposite concavity (e.g. concave v. convex) than the dome when viewed in cross section. The addition of ribs on the base alters the force profile resisting the load forces on the dome. The structure of the ribs can more uniformly distribute the stress on the base to minimize points of stress concentrations. Embodiments provide a base for a plastic beverage container that enables higher loadings with less material in the base of the plastic beverage container.

In addition to the ribs, a beverage container may include feet. The feet help inhibit the deformation of a bearing zone of the base of the beverage container. The feet also support the dome and inhibit asymmetric dome loading. A foot may be formed between each rib. The foot may have a seat on which the beverage container rest when the beverage container is placed on a horizontal surface. The feet and ribs may extend from the bearing zone to the base of the beverage container. The feet and ribs may also help stabilize the bearing zone to inhibit deformation of the bearing zone. Additionally, the feet help stabilize the beverage container when the beverage container is placed on a surface, such as a table.

These and other embodiments are discussed below with reference to the figures.

A beverage container 10 may have a body 30 with beverage container side walls 50 and a base 100. Base 100 of beverage container 10 may extend from beverage container side walls 50. FIG. 1 shows beverage container 10 having body 30 with beverage container side walls 50. Base 100 also has a vertical axis 200. Vertical axis 200 may define an axis of symmetry for beverage container 10 and base 100. That is, beverage container 10 or base 100 may be symmetric across a vertical plane that includes vertical axis 200. A skirt 110 of base 100 may extend from beverage container side walls towards vertical axis 200.

Figure 2:
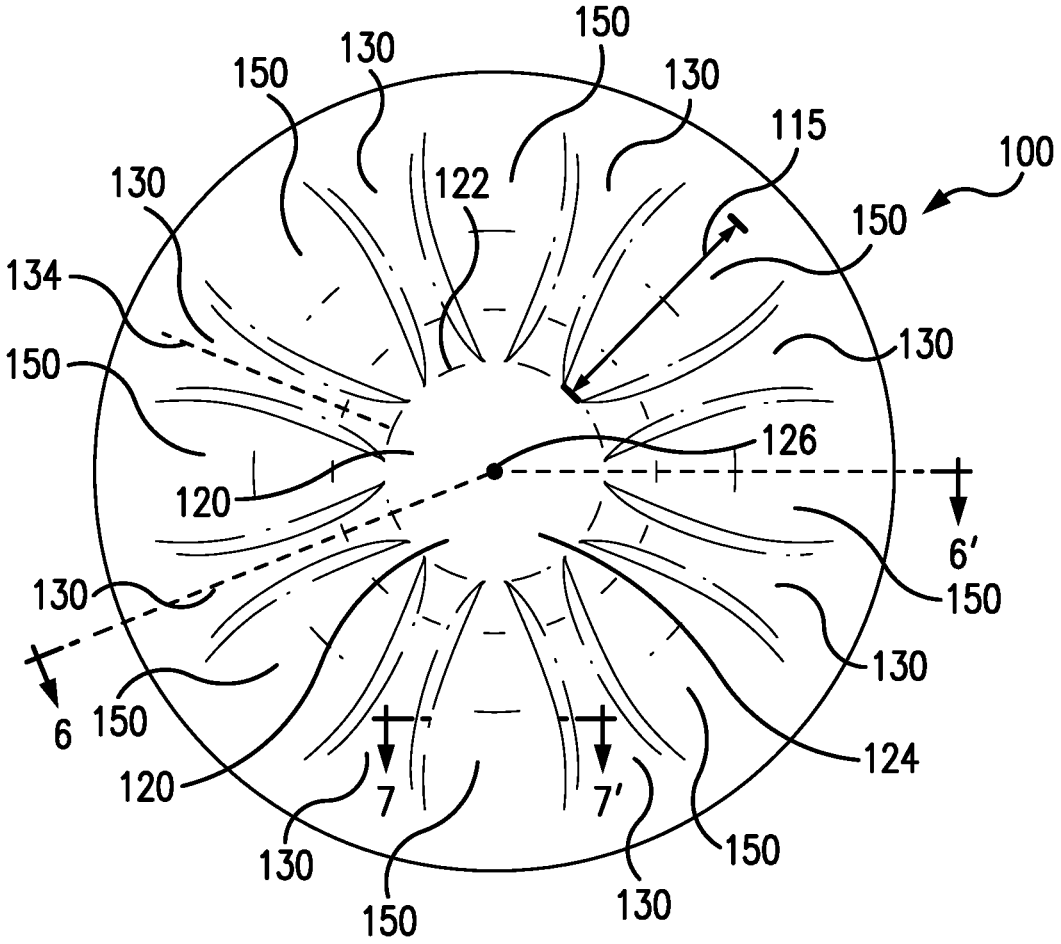
FIG. 2 is a top interior view of the base of the beverage container of FIG. 1.

As shown in FIG. 2, base 100 may include a dome 120 and bearing zone 115 extending between dome 120 and skirt 110. For clarity in FIG. 2, bearing zone 115 is represented by a bounded line. It should be understood that bearing zone 115 is the area defined by this line when it is rotated about vertical axis 200 of base 100. Dome 120 may have a smooth region 124 bounded by a dome boundary 122. Dome boundary 122 may not be a physical boundary line but may instead be defined by the line where smooth region 124 begins. Smooth region 124 may be smooth because no interrupting features of base 100 extend into this region. However, smooth region 124 may not necessarily be smooth in the textured sense. For example, it may have portions relating to the manufacturing process of beverage container 10 such as a surface texture or a blow mold feature, such as a compressed piece of plastic such as a nub at an apex 126. Apex 126 may be in smooth region 124 and may be aligned with vertical axis 200. Apex 126 may be the highest point of dome 120 when base 100 is placed on horizontal surface.

The force from internal pressure in beverage container 10 (e.g., from a carbonated beverage sealed therein) on dome 120 may be distributed to other portions of base 100. For example, bearing zone 115 may support dome 120. As shown in FIGS. 2-5, bearing zone 115 may include ribs 130 extending from dome 120 to skirt 110. Each rib 130 may follow a generally parabolic shape as it transitions from skirt 110 to dome 120 and each rib 130 may have a transition point 132. Transition point 132 may be the lowest point along a center line 134 of its rib 130 when base 100 is on a horizontal surface. In some embodiments, a tangent line at transition point 132 may also have zero slope. That is, a tangent line at transition point 132 through vertical axis 200 may be parallel to a horizontal surface 202.

Figure 3:
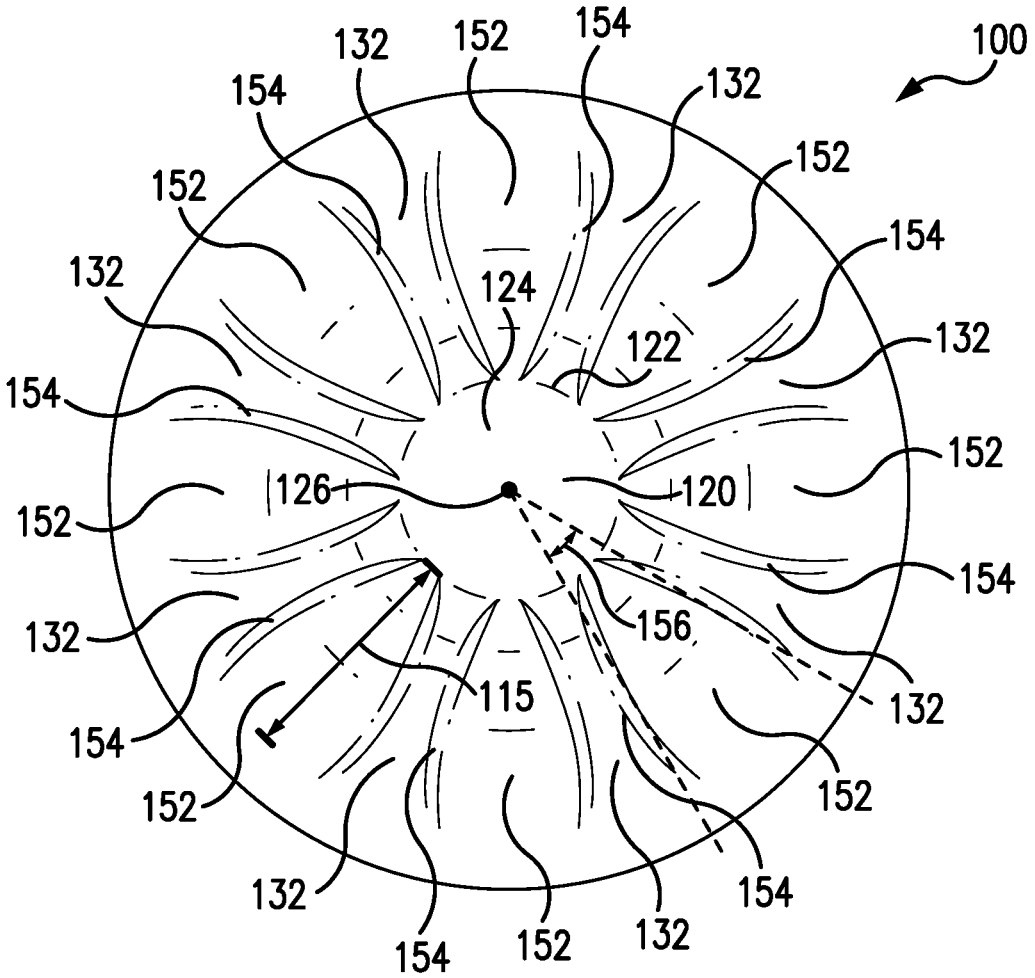
FIG. 3 is a bottom view of the base of FIG. 2.
Figure 4:
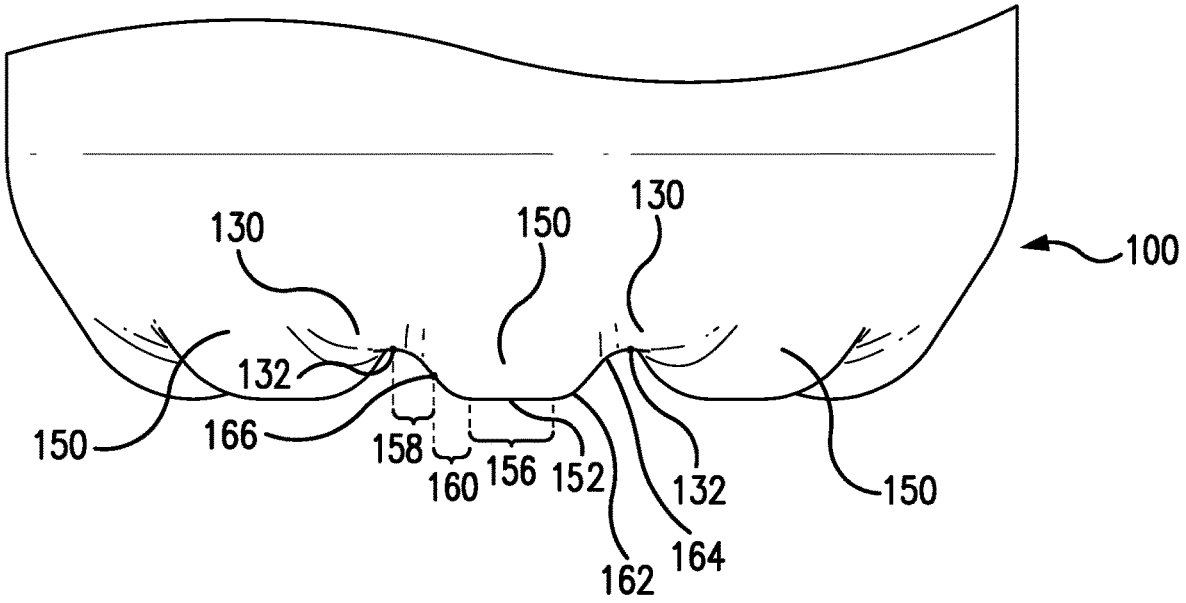
FIG. 4 is a front view of the base of FIG. 2.
Figure 5:
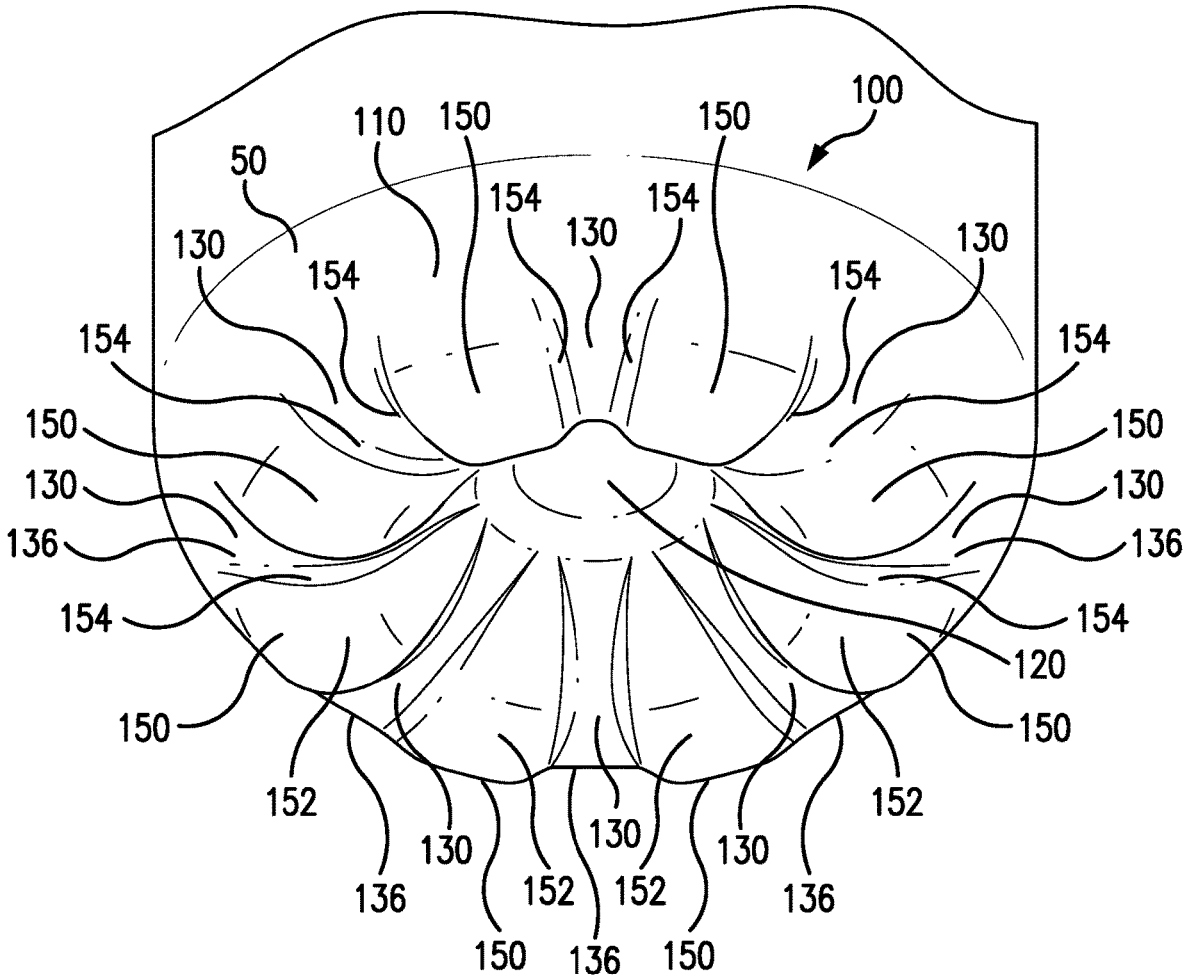
FIG. 5 is a bottom perspective view of the base of FIG. 2.

As shown in FIGS. 3 and 4, a foot 150 may be formed between adjacent ribs 130. Each foot 150 may have a seat 152. Seat 152 is the lowest portion of base 100. Seat 152 of base 100 is the portion of beverage container 10 on which beverage container 10 rests when beverage container 10 is on a surface (e.g., horizontal surface 202). Horizontal surface 202 may be a horizontal plane defined by the seats 152. Seat 152 may have a seat width 156. Seat width 156 may be either a numeric measurement, such as 3 mm, 5 mm, 8 mm, 11 mm, etc. or it may be an angular measurement like that shown in FIG. 3. FIG. 3 shows an angle between two lines extending from a point beneath apex 126 on horizontal surface 202 (shown in FIG. 6) to the seat-to-sidewall transition 162 of seat 152. This angle may define seat radial width 156. In some embodiments, seat width 156 is between 10° and 20°, for example, 5°, 8°, or 17°. The outer extents of seat width 156 may be defined as the points where seat 152 begins to transition upward toward (e.g., toward an adjacent rib 130). In some embodiments, the number of feet 150 may be defined in part by seat width 156. For example, increasing seat width 156 may mean decreasing the number of feet 150. In some embodiments, base 100 has 4-10 feet 150.

FIG. 4 shows a front view of base 100. FIG. 4 identifies different portions of base 100. For example FIG. 4 shows portions of foot sidewall 154. In some embodiments foot sidewall 154 has a lower portion 158 and an upper portion 160. An inflection point 166 between lower portion 158 and upper portion 160 is a point where the curvature of foot sidewall 154 changes direction. FIG. 4 also shows seat-to-sidewall transition 162 and sidewall-to-rib transition 164. Seat-to-sidewall transition 162 may be smooth. Similarly, sidewall-to-rib transition may also be smooth. A smooth transition may be defined as a curve not having sharp angles (e.g., maintaining a radius of at least 2 mm) and that is continuously differentiable. Foot sidewalls 154 also help inhibit and control deformation of bearing zone 115. In some embodiments, foot sidewalls 154 may deform when the pressure on dome 120 increases. Specifically, portions of foot sidewall 154 may become collinear with seat width 156 such that seat width 156 increases.

Figure 6:
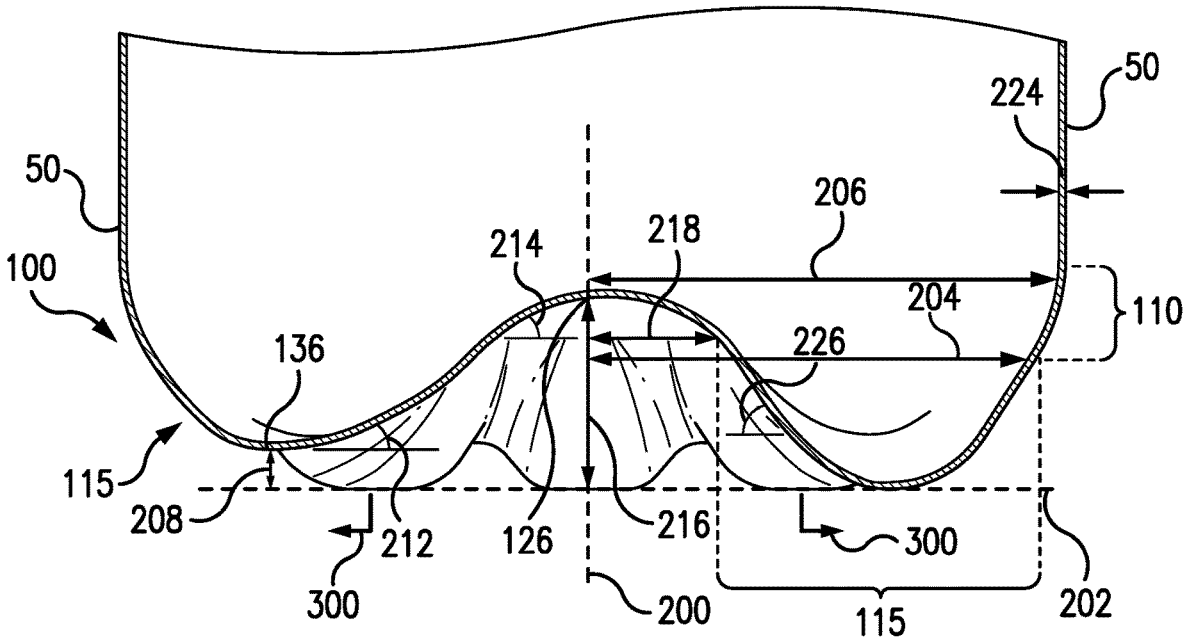
FIG. 6 is a cross section view of the base of FIG. 2 taken along the line 6-6' of FIG. 2.

FIG. 6 shows a cross section of base 100 taken along line 6-6' of FIG. 2. The left side of FIG. 6 is a cross section through a rib 130 and the right side of FIG. 6 is a cross section through a foot 150. FIG. 6 indicates several dimensions. Outer skirt radius 204 is the widest part of skirt 110. In some embodiments, outer skirt radius 204 may also be the width of beverage container 10. Skirt 110 has an inner skirt radius 206. Inner skirt radius is the radius of inner skirt at a point where rib 130 begins. Inner skirt radius is less than outer skirt radius 204. In some embodiments, outer skirt radius may be between 20 and 40 mm. In some embodiments outer skirt radius 204 may be between 32 mm and 37 mm. In some embodiments inner skirt radius 206 may be between 25 mm and 35 mm. For example, inner skirt radius 206 may be 30 mm.

In some embodiments, ribs 130 may have a rib height 208. Rib height 208 is a distance between the lowest point of centerline 134 of rib 130 and a horizontal surface 202 that extends between the seats 152 of feet 150. In some embodiments, the location on rib 130 where rib height 208 is measured may correspond to transition point 132. In some embodiments, rib height 208 may be relatively small in comparison to other dimensions of base 100. For example, rib height may be less than 7 mm. In some embodiments, rib height 208 may be 3.5 mm. Minimizing rib height 208 reduces the visual prominence of ribs 130 and feet 150 to give beverage container 10 does not look like a traditional carbonated soft drink base, which may be a petaloid base with large or pronounced feet. In some embodiments, rib 130 has a rib angle 212. Rib angle 212 is an angle that rib 130 extends at toward dome 120. Rib angle 212 may be shallower or may be greater than dome angle 214. For example, rib angle 212 may be 45°. Rib angle 212 may also be between 30° and 60°. In some embodiments, rib angle 212 is defined as the angle between horizontal surface 202 and a line between transition point 136 and dome boundary 122.

Dome 120 may have a dome height 216. Dome height 216 may be proportional to the outer skirt radius 204. For example, in some embodiments dome height 216 is greater than outer skirt radius 204. For example, dome height 216 may be between 0.2 and 2 times outer skirt radius 204. In some embodiments, dome height 216 may be between 0.3 and 1 times outer skirt radius 204. For example, dome height 216 may be 0.4 times outer skirt radius 204.

Additionally dome 120 may have a dome radius 218. Dome radius 218 may be the radius of dome 120 at dome boundary 122. In some embodiments, dome radius 218 is proportional to outer skirt radius 204. For example, in some embodiments dome radius 218 may be between $1/3^{rd}$ and $1/7^{th}$ outer skirt radius 204. For example, dome radius 218 may be 10 mm. Also, in some embodiments, foot 150 may have a foot angle 226 described as an angle between a tangent line formed at a point on an interior side of foot 150 and horizontal surface 202. The interior side of foot 150 may be a point between seat 152 and dome boundary 122. In some embodiments foot angle is greater than rib angle 212. For example, foot angle 226 may be greater than 30°, 35°, 40°, 45°, 50°, 55°, or 60°.

Dome 120 has a dome angle 214. Dome angle 214 may be defined as the angle between a horizontal line and a tangent line formed at dome boundary 122 and extending through vertical axis 200. In some embodiments, dome angle 214 may be between 10° and 60°. A dome angle 214 in excess of 45° is preferable because it more effectively concentrates the loading on dome 120. In some embodiments, dome angle 214 is greater than 30°, 35°, 40°, 45°, 50°, 55°, or 60°. When beverage container 10 contains a beverage, dome 120 is subject to loading. This loading is increases when the contained beverage is a pressurized beverage such as soda or carbonated water. The pressure inside beverage container may be between 2.7 and 4.2 atmospheres. Dome 120 supports the force exerted by this pressure.

Figure 7:
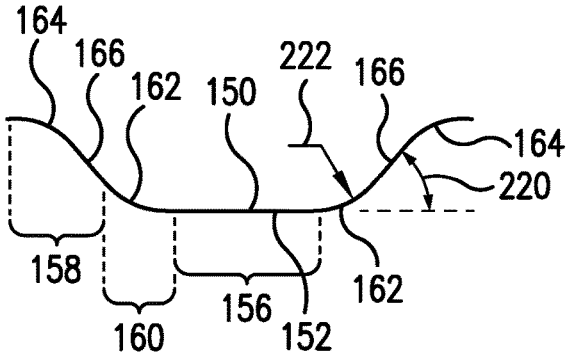
FIG. 7 is a section view of the base of FIG. 2 taken along the line 7-7' of FIG. 2.

FIG. 7 shows a cross section of base 100 taken at the line 7-7' shown in FIG. 2. The cross section of FIG. 7 extends between two adjacent ribs 130 through foot 150. As shown in FIG. 7, a sidewall angle 220 is defined by the angle of sidewall 154 at inflection point 166 relative to horizontal. As stated above, inflection point 166 is a point between upper portion 160 and lower portion 158 of sidewall 154. Sidewall angle 220 may be between 30° and 60° and more specifically, may be between 40° and 52°. Additionally, in some embodiments, a fillet radius 222 at the seat to sidewall transition may be greater than 2 mm. In some embodiments, fillet radius 222 may be between 1 mm and 4 mm. Fillet radius 222 may increase when beverage container 10 contains a pressurized gas and the force on dome 120 increases. For example, when beverage container 10 is pressurized to between 2.7 and 4.3 atmospheres, fillet radius 222 may be between 1 mm and 6 mm.

Smooth transitions between surfaces minimizes stress concentrations in base 100. In some embodiment, all points on the surface of base 100 are differentiable. That is, there are no sharp transitions between surfaces. Minimizing stress concentrations allows base 100 to be formed with less material, reducing costs and weight. Additionally, using smooth transitions in base 100 may give base 100 a uniform thickness 224. In addition, as the pressure loading on dome 120 increases, feet 150 may also deform reducing the amount of seat 152 in contact with a horizontal surface. Using smooth transitions allows for portions of foot sidewall 154 to absorb the deformation of seat 152.

The smooth shape of base 100 and the increased dome height 216 may give another benefit to the structure of base 100. In some embodiments, base 100 may be formed in a blow molding process from biaxially oriented polyethylene terephthalate (PET). Base 100's smooth shape and increased dome height 216 prevents a buildup of PET in the base and makes sure the PET is stretched across the surface of base 100. Stretching PET sufficiently helps internally orient the structure of the PET. Specifically, it contributes to the "orienting" of the PET. Proper orientation of the PET material increases its overall strength and allows thinner sections to bear greater loads.

The stretching of PET may be aided by increased surface area of base 100. The surface area of base 100 is increased using an increased dome height 216 and using smooth, as opposed to sharp, transitions between different structures on base 100. In some embodiments, a surface area of base 100 may be twice the area of a circle having a radius equal to outer skirt radius 204. In some embodiments, the surface area of base 100 may be between 1.5 and 2.5 times larger than the area of a circle having a radius equal to outer skirt radius 204.

Additionally, the increased height of dome 120 may increase the vertical force on feet 150. In response to the increased force, foot 150 may adapt to the increased pressure by moving out from vertical axis 200 slightly in direction 300. This moving out, or splaying, of feet 150 keeps them in contact with horizontal surface 202 and increase the contact area. The increased contact area keeps beverage container 10 supported.

It is to be appreciated that the Detailed Description section, and not the Summary and Abstract sections, is intended to be used to interpret the claims. The Summary and Abstract sections may set forth one or more but not all exemplary embodiments of the present disclosure but are not intended to limit the present disclosure and claims in any way.

The foregoing description of the specific embodiments so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments, but should be defined only in accordance with the following claims and their equivalents.

What is claimed is:

1. A beverage container comprising:
a body; and
a base comprising:
a skirt extending from the body;
a smooth dome;
ribs extending from the skirt and the dome; and
feet, each foot formed between a pair of adjacent ribs and extending from the skirt to the dome, and each foot having a seat and two sidewalls;
wherein each rib has a transition point between the skirt and the dome,
wherein a tangent line formed at each transition point has a slope of zero, and
wherein a seat-to-sidewall transition of each foot is smooth.

2. The beverage container of claim 1, wherein a dome angle between a horizontal line and a tangent line formed at a dome boundary defined by a smooth region of the dome is greater than 30 degrees.

3. The beverage container of claim 1, wherein each rib has a rib height measured from a horizontal plane defined by the seats of the feet and the dome has a dome height measured from the horizontal plane defined by the seats of the feet, and wherein the dome height is greater than 4 times the rib height.

4. The beverage container of claim 1, wherein the base has a horizontal outer skirt radius and the dome has a dome height, and wherein the dome height is greater than 0.3 times the horizontal outer skirt radius.

5. The beverage container of claim 1, further comprising:
wherein an angle between two lines extending from a point beneath an apex of the dome in a horizontal plane defined by the seats of the feet to the seat-to-sidewall transitions of the seat of a foot defines a seat radial width, and
wherein each foot has a seat radial width less than 20 degrees.

6. The beverage container of claim 5, wherein each foot has a seat radial width less than 17 degrees.

7. The beverage container of claim 1, wherein the number of feet is 8.

8. The beverage container of claim 1, wherein the smooth seat-to-sidewall transition of each foot has a filet radius greater than 1 mm.

9. The beverage container of claim 1, wherein the base has a horizontal outer skirt radius, and wherein each rib has a rib height measured from a horizontal plane defined by the seats of the feet less than ⅙ the horizontal outer skirt radius.

10. The beverage container of claim 1, wherein each rib has a rib height measured from a horizontal plane defined by the seats of the feet between 1 mm and 6 mm.

11. The beverage container of claim 1, where the slope of a tangent line formed in a plane connecting two adjacent seats at any point between two adjacent seats has a slope less than 1.3.

12. A base for a beverage container, the base comprising:

a smooth dome having a vertical axis, smooth ribs extending from the dome to a skirt, feet, each foot formed between a pair of adjacent ribs and extending from the skirt to the dome, each foot having a seat and two sidewalls, wherein a sidewall-to-rib transition is smooth, wherein a seat-to-sidewall transition is smooth, and wherein neither the feet nor the ribs extend beyond a dome boundary defined by a smooth region.

13. The base of claim 12, wherein each sidewall has a sidewall angle defined by a horizontal line and a tangent line formed at a sidewall inflection point, wherein the sidewall angle is between 30 degrees and 60 degrees.

14. The base of claim 12, wherein the sidewall has a sidewall angle defined by a horizontal line and a tangent line formed at a sidewall inflection point, wherein the sidewall angle is between 40 and 52 degrees.

15. The base of claim 12, further comprising:

wherein each rib has a transition point between the skirt and the dome, wherein an angle between a horizontal surface and a line extending between the transition point and the dome boundary where the rib meets the dome boundary defines a rib angle, wherein each of the ribs has a rib angle between 40 degrees and 50 degrees.

16. The base of claim 12, further comprising:

a dome height measured from a horizontal plane, wherein the smooth region of the dome defines a dome radius, and wherein the dome height is between 0.3 and 0.7 times the dome radius.

17. The base of claim 12, wherein each rib has a rib height measured from a horizontal plane between 1 mm and 6 mm.

18. The base of claim 12, further comprising:

wherein an angle between two lines extending from a point beneath an apex of the dome in a horizontal plane defined by the seats of the feet to the seat-to-sidewall transitions of the seat of a foot defines a seat radial width, and wherein each foot has a seat radial width less than 12 degrees.

19. The base of claim 12, wherein foot has a seat radial width less than 5 mm.

20. The base of claim 12, wherein each foot has a foot angle at a point on the interior of the foot, the foot angle defined between a tangent line at the point and a horizontal plane, and wherein the foot angle is greater than 50 degrees.

21. A beverage container comprising:

a body; and a base comprising:

a skirt extending from the body;

a smooth dome centered on a vertical axis;

ribs extending from the skirt and the dome; and feet, each foot formed between a pair of adjacent ribs and extending from the skirt to the dome, and each foot having a seat and two sidewalls;

wherein each rib has a transition point between the skirt and the dome, wherein a tangent line formed at each transition point has a slope of zero, and wherein when the beverage container is pressurized, the feet splay away from the vertical axis.

22. The beverage container of claim 21, wherein the dome has an apex aligned with the vertical axis.

* * * * *